US005549094A

United States Patent [19]

Tomisawa

[11] Patent Number: 5,549,094

[45] Date of Patent: Aug. 27, 1996

[54] FUEL VAPOR CONTROL FOR INTERNAL COMBUSTION ENGINE

[75] Inventor: Naoki Tomisawa, Atsugi, Japan

[73] Assignee: Unisia Jecs Corporation, Atsugi, Japan

[21] Appl. No.: 384,831

[22] Filed: Feb. 7, 1995

[30] Foreign Application Priority Data

Feb. 9, 1994 [JP] Japan ..... 6-015392

[51] Int. Cl.[6] ..... F02M 25/08

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 4,137,882 | 2/1979 | Thornburgh | 123/520 |
| 4,149,504 | 4/1979 | Walters | 123/520 |
| 4,153,025 | 5/1979 | Thornburgh | 123/520 |
| 4,961,412 | 10/1990 | Furuyama | 123/520 |
| 5,020,503 | 6/1991 | Kanasashi | 123/520 |
| 5,090,388 | 2/1992 | Hamburg et al. | 123/520 |
| 5,263,460 | 11/1993 | Baxter et al. | 123/520 |
| 5,351,193 | 9/1994 | Poirier et al. | 123/520 |

FOREIGN PATENT DOCUMENTS 62-7962 1/1987 Japan .

*Primary Examiner*—Thomas N. Moulis
*Attorney, Agent, or Firm*—Foley & Lardner

[57] ABSTRACT

A fuel vapor control system for an internal combustion engine is constructed so as to first determine a basic purge gas quantity based on an operating condition of the engine, then corrects the basic purge gas quantity in accordance with an altitude at which the engine is located and determines a conclusive purge gas quantity. The conclusive purge gas quantity is determined so as to increase as the altitude becomes higher, whereby the escape of fuel vapor from the intake system of the engine can be prevented with efficiency and assuredness.

4 Claims, 8 Drawing Sheets

FUEL VAPOR CONTROL FOR INTERNAL COMBUSTION ENGINE

BACKGROUND OF THE INVENTION

1. Field of the Invention

The present invention relates in general to an evaporative control in an internal combustion engine adapted to trap fuel vapor in a fuel tank, etc. of a fuel supply system of the engine and supply the vapor together with air to an intake passage, etc. of the intake system and more particularly to a purge gas quantity control in such an internal combustion engine.

2. Description of the Prior Art

A fuel vapor control system has heretofore been proposed in which fuel vapor in a fuel tank, etc. in a fuel supply system of an internal combustion engine is once trapped by a canister and then the trapped vapor is purged from the canister so that the purged air-fuel mixture (purge gas) is supplied by way of a purge line to an intake system of the engine, whereby to prevent the fuel vapor in the fuel tank, etc. from being emitted into the open air, as disclosed in JP-A-62-7962 (Laying-open publication of Japanese patent application).

In the above described fuel vapor control system for supplying the purge gas from the canister to the intake system of the engine, extra purge gas is added to usual air-fuel mixture, so there is a possibility of a large variation in air-fuel ratio due to the supply of the purge gas. The purge gas supply quantity is thus controlled so that its influence over the injection quantity Ti of fuel supplied to the engine is constant, e.g., the percentage of the purge gas quantity relative to the fuel injection quantity Ti is equal to or less than 10% or so. Specifically, a purge gas quantity is determined so as to have a predetermined ratio relative to a basic fuel injection quantity $T_P$ or the like engine operating condition, and the width of pulse for drive of a purge control valve serving as a purge gas quantity altering means is controlled so that the purge gas quantity determined as above is attained.

However, with the structure adapted to control the purge gas quantity in accordance with the basic fuel injection quantity $T_P$, the purge gas quantity is caused to decrease as the vehicle goes to a higher altitude, and it becomes impossible to attain a required purge gas quantity, resulting in that fuel vapor is escaped from the canister and hydrocarbons HC are emitted into the open air. Due to this, there exists a problem that the emission control standards having become more stringent recently cannot be met.

In this instance, the reason why the purge gas quantity reduces as the vehicle goes to higher altitudes is as follows. That is, consider a case in which a vehicle whose engine is conditioned so as to meet the requirement for the purge gas quantity at flatlands or low altitudes, goes to highlands or higher altitudes. The purge gas quantity is firstly determined by the difference of the pressures across the purge control valve ($P_P$–$P_E$) and the opening area of the purge control valve (i.e., drive pulse width).

When going to higher altitudes, the atmospheric pressure PA becomes lower. Due to this, when the same basic fuel injection quantity $T_P$ as that at flatlands is given, the pressure $P_E$ downstream of the purge control valve becomes higher. Thus, assuming that the pressure $P_P$ upstream of the purge control valve is constant, controlling the purge control valve by the same drive pulse width causes the purge gas quantity to be reduced.

On the other hand, the pressure within the fuel tank is determined by the check valve for the fuel tank and the atmospheric pressure, so the pressure within the fuel tank becomes lower at higher altitudes, and also the pressure $P_P$ upstream of the purge control valve becomes lower.

As a result, the differential pressure ($P_P$–$P_E$) across the purge control valve becomes smaller, and thus the purge gas quantity is reduced.

SUMMARY OF THE PRESENT INVENTION

In accordance with the present invention, there is provided a fuel vapor control system for an internal combustion engine, which comprises fuel vapor adsorbing means for adsorbing fuel vapor produced in a fuel supply system of the engine, purge means for purging fuel vapor from the fuel vapor adsorbing means and supplying it together with air to the intake system of the engine, purge gas quantity altering means for altering a quantity of purge gas purged from the fuel vapor adsorbing means and supplied to the intake system of the engine by way of the purge means, engine operating, condition detecting means for detecting an operating condition of the engine, basic purge gas quantity determining means for determining a basic purge gas quantity based on an engine operation condition detected by the engine operating condition detecting means, altitude detecting means for detecting an altitude at which the engine is located and producing a signal representative thereof, purge gas quantity correcting and determining means for correcting the basic purge gas quantity determined by the basic purge gas quantity determining means, in response to the signal from the altitude detecting means and determining a conclusive purge gas quantity, and purge gas quantity control means for controlling the purge gas quantity altering means based on the conclusive purge gas quantity corrected and determined by the purge gas quantity correcting and determining means.

The above structure is effective for solving the above noted problems inherent in the prior art system.

It is accordingly an object of the present invention to provide a novel and improved fuel vapor control system for an internal combustion engine which can prevent the escape of fuel vapor from the engine with efficiency and assuredness, irrespective variations of the altitude at which the engine is located.

It is a further object of the present invention to provide a novel and improved fuel vapor control system of the above described character which can assuredly attain a required purge gas quantity both at low altitudes and high altitudes and thus can meet with the emission control standards which have become more stringent recently.

DETAILED DESCRIPTION OF THE PREFERRED EMBODIMENTS

Figure 1:
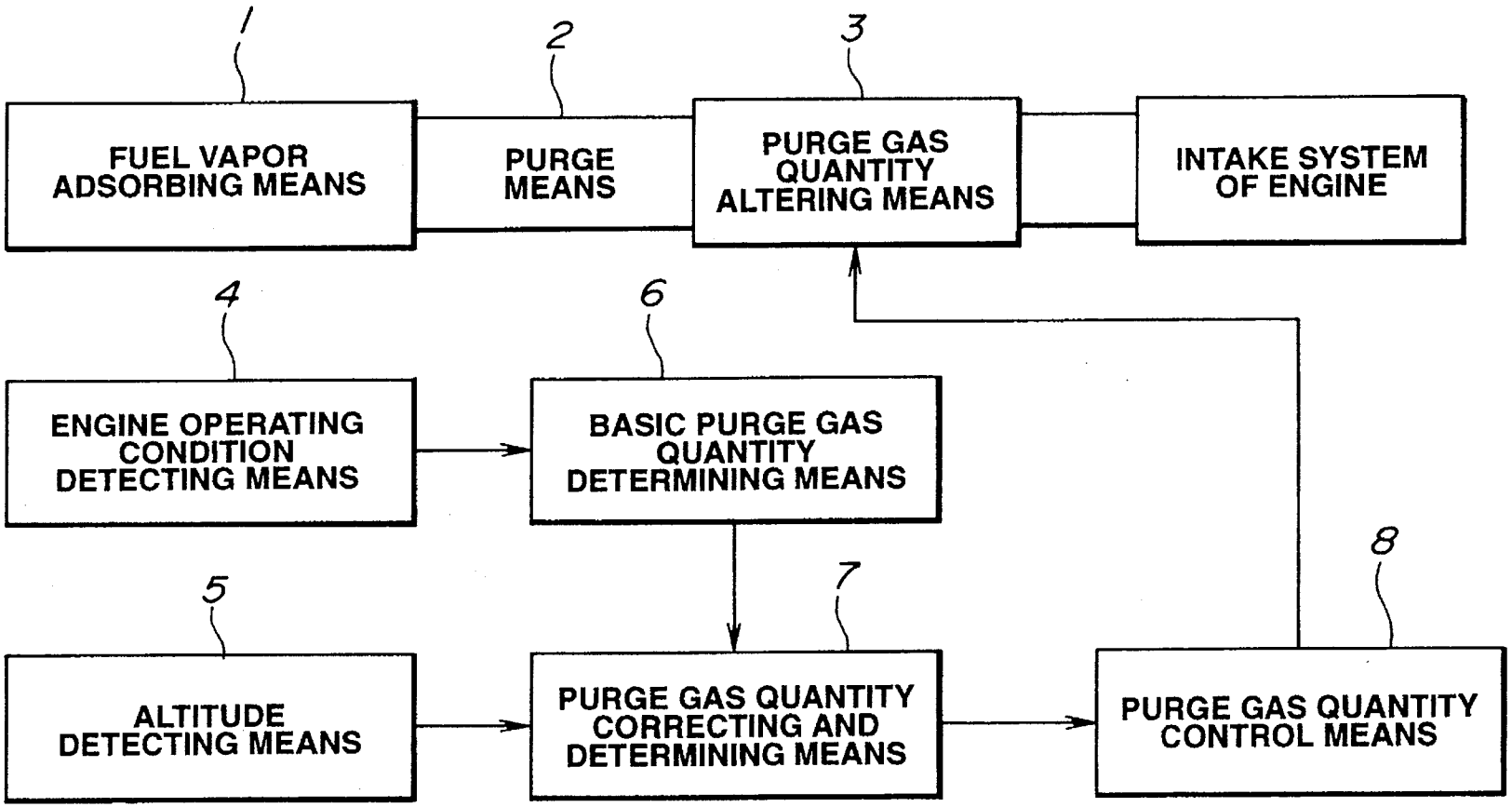
FIG. 1 is a block diagram for general illustration of a fuel vapor control system according to an embodiment of the present invention.
Figure 2:
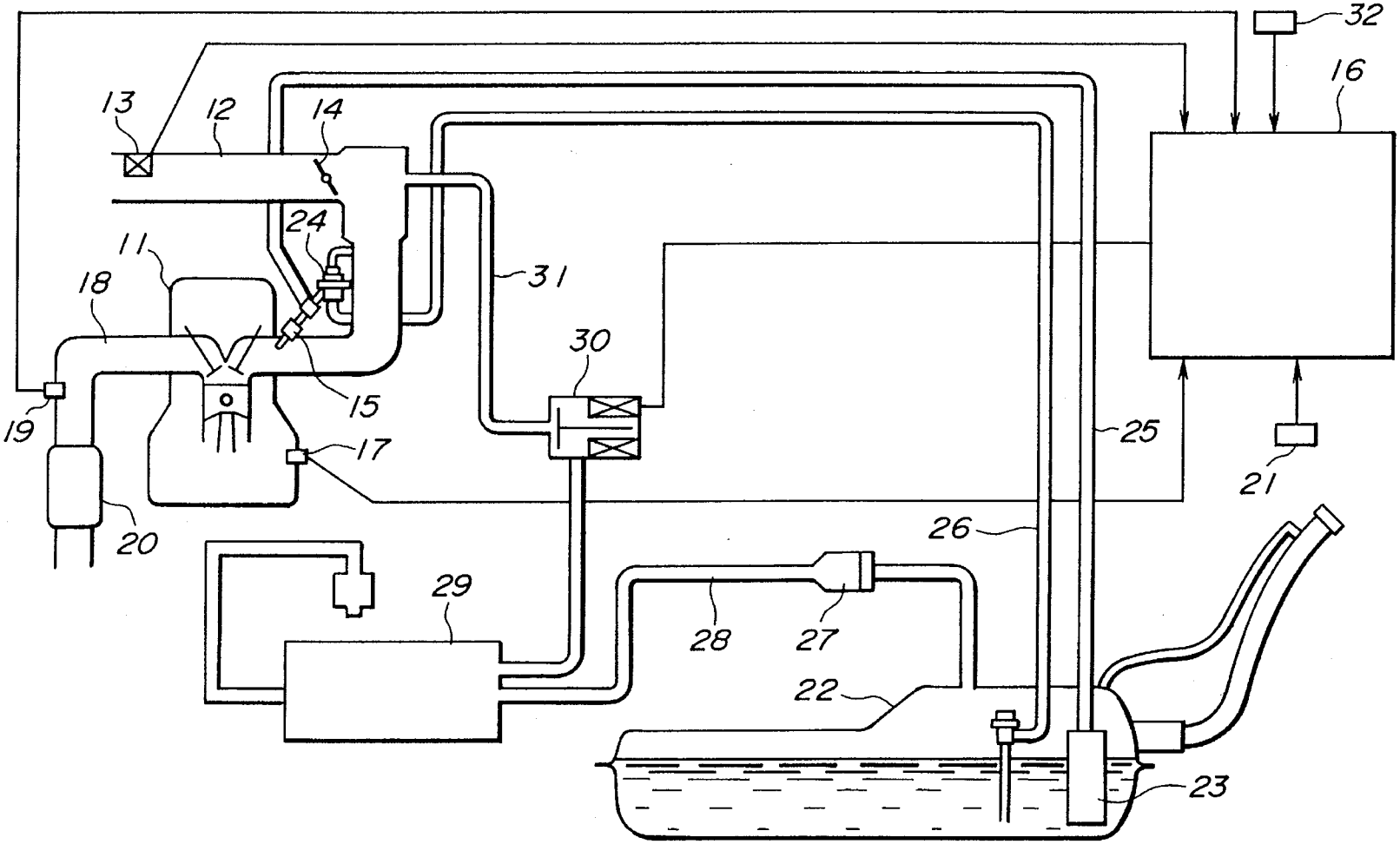
FIG. 2 is a schematic view for more specific illustration of the fuel vapor control system of FIG. 1.

Referring first to FIGS. 1 and 2, a fuel vapor control system according to an embodiment of the present invention will be described.

As shown in a block diagram of FIG. 1, a fuel vapor control system consists of a fuel vapor adsorbing means 1, a purge means 2, a purge gas quantity altering means 3, an engine operating condition detecting means 4, an altitude detecting means 5, a basic purge gas quantity determining means 6, a purge gas quantity correcting and determining means 7, and a purge gas quantity control means 8.

More specifically, with additional reference to FIG. 2, an engine 11 has an induction passage 12 which is provided with an airflow meter 13 for detecting a flow rate Q of intake air supplied by way of an air cleaner (not shown) and a throttle valve 14 movable in timed relation to an accelerator pedal (not shown) for controlling the flow rate Q of intake air. The intake passage 12 includes branch portions of an intake manifold downstream of the throttle valve 14 and is provided at each branch portion with a fuel injection valve 15 for each cylinder, constituting a fuel supply means.

The fuel injection valve 15 is driven by an injection pulse signal from a control unit (C/U) 16 comprised of a microcomputer, to open intermittently for injection of fuel to be supplied.

A coolant temperature sensor 17 is provided for detecting a temperature $T_w$ of coolant within a water jacket of the engine 11.

An exhaust passage 18 is provided at a collective portion of an exhaust manifold (i.e., a portion where manifold branches are collected) with an air-fuel ratio sensor (hereinafter referred to as oxygen sensor) 19 constituting a means for detecting an air-fuel ratio of an intake mixture by detecting the oxygen content in the exhaust gases and at an exhaust pipe downstream of the collective portion with a three-way catalytic converter 20 for oxidation of CO and HC and reduction of NOx for thereby purifying the exhaust gases.

A crank angle sensor 21 is incorporated in a distributor (not shown) to detect engine speed N by counting, for a fixed time, unit crank angle signals generated by the crank angle sensor 21 in timed relation to engine speed or by measuring the cycle in which a reference crank angle signal is generated by the crank angle sensor 21.

An atmospheric pressure sensor 32 is provided for constituting the altitude detecting means 5 for detecting an altitude by detecting an atmospheric pressure.

The fuel supply system of the engine 11 will now be described. Within a fuel tank 22, there is disposed a fuel pump 23, so that the fuel discharged from the fuel pump 23 is conducted through a fuel supply passage 25 and a pressure regulator 24 where it is regulated to a predetermined pressure and is supplied to the aforementioned fuel injection valve 15. The excess fuel from the pressure regulator 24 is returned through a return fuel passage 26 to the fuel tank 22.

Fuel vapor staying at an upper part of the space within the fuel tank 22 is drawn through a fuel vapor passage 28 provided with a check valve 27 into a canister 29 and is trapped by the canister 29. The fuel vapor temporarily trapped by the canister 29 is purged therefrom and drawn through a purge passage 31 equipped with a purge control valve 30 into the intake passage 12 downstream of the throttle valve 14.

In this instance, the structure for drawing the fuel vapor staying at the upper part of the space within the fuel tank 22, by way of the fuel vapor passage 28 and into the canister 29, and trapping the fuel vapor by the adsorbent within the canister 29, constitutes the fuel vapor adsorbing means 1 of the fuel vapor control system of this invention.

The structure for fluidly connecting the canister 29 to the intake passage 12 at a portion thereof downstream of the throttle valve 14 by way of the purge passage 31, constitutes the purge means 2 of the fuel vapor control system of this invention.

The purge control valve 30 constitutes the purge gas quantity altering means 3.

The control unit 16 determines the quantity of purge gas to be drawn into the engine 11 by way of the purge passage 31 based on detection signals from various sensors and controls the duty (i.e., turning on and off) of the purge control valve 30.

The purge gas control by the control unit 16 of the fuel vapor control system according to an embodiment of the present invention will be described with reference to the flow chart of FIG. 3.

Figure 3:
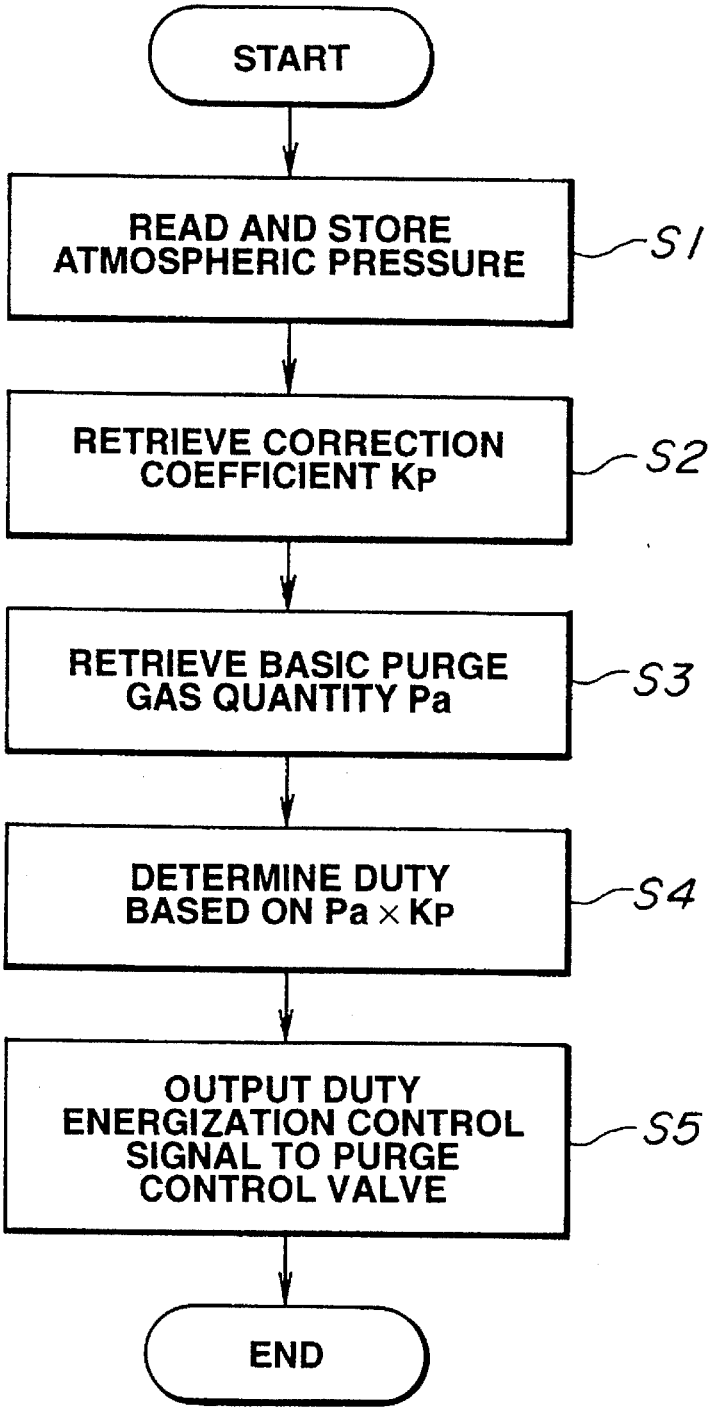
FIG. 3 is a flow chart for illustration of a control effected by the fuel vapor control system of FIG. 1.

In the meantime, as will be seen from the flow chart of FIG. 3, the basic purge gas quantity determining means 6, the purge gas quantity correcting and determining means 7 and the purge gas quantity control means 8 are constituted by the software or programs of the control unit 16.

In this embodiment, the engine operating condition detecting means 4 is constituted by the airflow meter 13 and the crank angle sensor 21.

Further, in this embodiment, the basic purge gas quantity determining means 6 is constructed so as to determine a basic purge gas quantity corresponding to a present engine operating condition by retrieval from a memory means in which basic purge gas quantity in relation to a parameter of engine operation condition is stored.

The basic purge gas quantity determining means 6 may be constructed so as to determine a basic purge gas quantity based on a basic fuel supply quantity representing an engine operating condition.

The purge gas quantity correcting and determining means 7 is constructed so as to correct the purge gas quantity in such a manner that the purge gas quantity increases as the altitude becomes higher.

In this embodiment, the altitude detecting means 5 is constituted by the atmospheric pressure sensor 32 which serves as an atmospheric pressure detecting means for detecting the atmospheric pressure.

Figure 4:
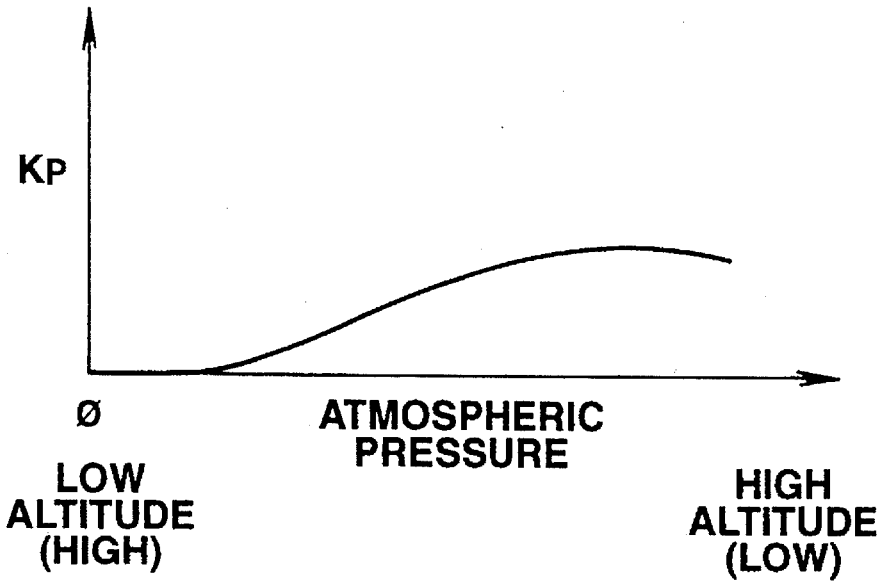
FIG. 4 is a graph for illustration of a map table, previously stored, of a relation of correction coefficient $K_P$ and atmospheric pressure.

In the flow chart of FIG. 3, in step S1 the atmospheric pressure is detected by the atmospheric pressure sensor 32 and stored in the memory. In step S2, the correction coefficient $K_P$ for correcting a purge gas quantity which is determined in such a manner as will be described later, is set. The correction coefficient $K_P$ is set to such a value as to cause the purge gas quantity to increase as the atmospheric pressure becomes lower, i.e., as the altitude becomes higher, and is actually determined through retrieval from a map table as shown in FIG. 4 and previously stored in a read-only memory (ROM).

Figure 5:
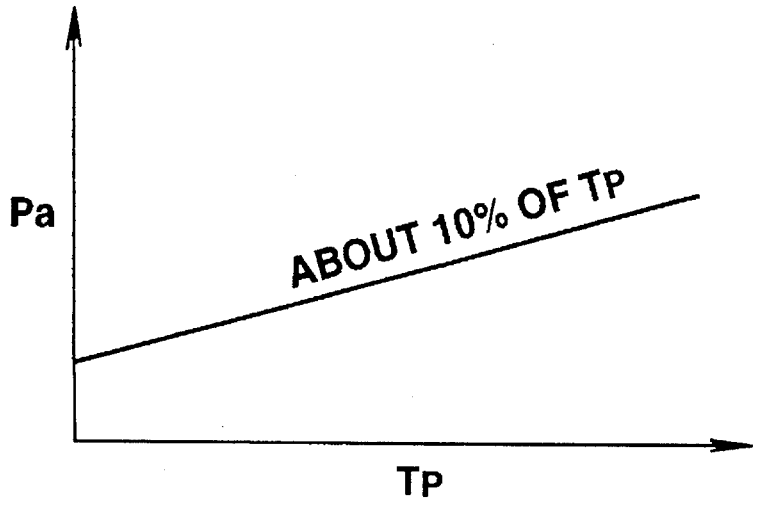
FIG. 5 is a graph for illustration of a map table, previously stored, of a relation of a basic fuel injection quantity $T_P$ and a basic purge gas quantity Pa.

In step S3, a basic purge gas quantity Pa corresponding to a present fuel injection quantity $T_P$ is retrieved from the map table as shown in FIG. 5 and previously stored in a read-only memory (ROM) for determining a basic purge gas quantity Pa in relation to a parameter of a basic fuel injection quantity $T_P$ of the fuel injection valve which is calculated based on flow rate Q of intake air and engine speed N. In this instance, the percentage of the basic purge gas quantity Pa relative to the basic injection fuel quantity $T_P$ is set to a predetermined value (e.g., about 10%).

In step S4, the basic purge gas quantity Pa obtained in the step S3 is multiplied by the correction coefficient $K_P$ also obtained in the step S3, and lastly the duty for controlling the on/off operation of the purge control valve 30 is determined. In step S5, an energization control signal representing the duty is supplied to the purge control valve 30, whereby the quantity of purge gas supplied to the engine by way of the purge control valve 30 is altered under control.

As described above, in this embodiment, the atmospheric pressure is detected by the atmospheric pressure sensor 32, and as the atmospheric pressure becomes lower, i.e., as the altitude becomes higher the purge gas quantity is increased, whereby it becomes possible to attain a required purge gas quantity both in lowlands and highlands, thus making it possible to prevent the escape of fuel vapor and therefore hydrocarbons (HC) from being emitted into the atmosphere, and therefore making it possible to meet with the emission control standards which have become more stringent recently.

Another embodiment will be described hereinlater.

In this embodiment, the above described altitude detecting means 5 is constructed so as to estimate the altitude based on the result of comparison between a basic fuel injection quantity $T_{P\alpha\text{-}N}$ determined depending upon engine speed N and opening area α represented by throttle valve opening (hereinafter referred to simply as throttle opening area) and a basic supply fuel quantity $T_P$ calculated depending upon engine speed N and flow rate Q of intake air.

That is, in this embodiment, the altitude detecting means 5 is constituted by the crank angle sensor 21 serving as an engine speed detecting means for detecting engine speed N, an opening area detecting means for detecting a throttle opening area α which is controlled by the throttle valve 14 serving as an intake air flow rate control means, the airflow meter 13 for detecting a flow rate Q of intake air, a basic fuel supply quantity determining means for determining the basic fuel injection quantity $T_{P\alpha\text{-}N}$ as a basic fuel supply quantity depending upon detected engine speed N and detected opening area α, a basic fuel supply quantity calculating means for calculating a basic fuel injection quantity TP depending upon detected engine speed N and detected flow rate Q of intake air, and a means for estimating an altitude based on the result of comparison between the determined basic fuel injection quantity $T_{P\alpha\text{-}N}$ and the calculated basic fuel injection quantity $T_P$.

The control routine effected by this embodiment will be described with reference to the flow chart of FIG. 6.

Figure 7:
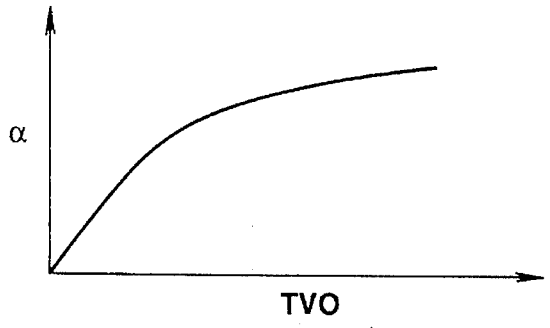
FIG. 7 is a graph for illustration of a map table, previously stored, of throttle opening $\alpha$ in relation to a parameter of throttle valve opening TVO.
Figure 8:
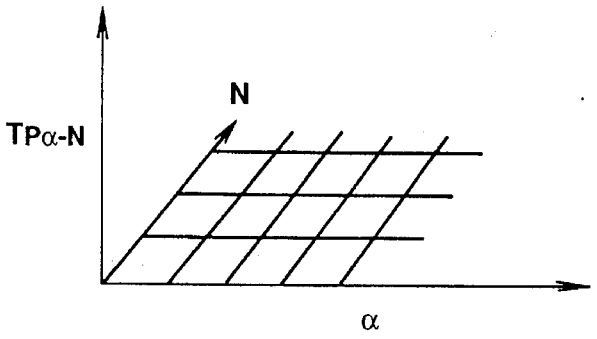
FIG. 8 is a graph for illustration of a map table, previously stored, of basic fuel injection quantity $T_{P\alpha\text{-}N}$ in relation to a parameter of engine speed N and throttle opening area $\alpha$.

In this flow chart, in step S11 engine speed N is read and stored. In step S12, the throttle opening area α corresponding to the present throttle valve opening degree TVO is retrieved from the map table, sotred in a read-only memory(ROM), of throttle opening area α in relation to a parameter of throttle valve opening degree TVO, as shown in FIG. 7. In step S13, the basic fuel injection quantity $T_{P\alpha\text{-}N}$ corresponding to the present engine speed N and the present throttle opening area α (i.e., the engine speed N and the throttle opening area α occurring at the present time), is retrieved from the map table, stored in a read-only memory, of basic fuel injection quantity $T_{P\alpha\text{-}N}$ in relation to a parameter of throttle opening area α, as shown in FIG. 8.

In step S14, the basic fuel injection quantity TP is calculated by the following expression.

$$T_P=(Q/N)\times K$$

where Q is flow rate of intake air, N is engine speed and K is constant for determining basic air-fuel ratio.

In step S15, the difference $(T_P-T_{P\alpha\text{-}N})$ between the basic fuel injection quantity TP obtained in the step S14 and the basic fuel injection quantity $T_{P\alpha\text{-}N}$ obtained in the step S13 is calculated.

In this instance, the above described difference $(T_P-T_{P\alpha\text{-}N})$ is related to the altitude and becomes larger as the altitude becomes higher. Accordingly, the altitude can be estimated based on $(T_P-T_{P\alpha\text{-}N})$.

Figure 9:
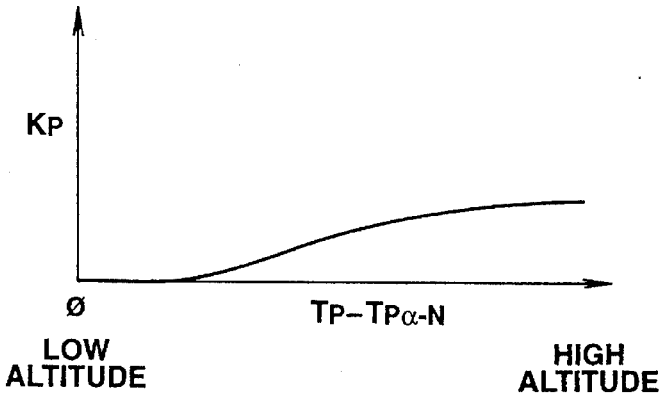
FIG. 9 is a graph for illustration of a map table, previously stored, of a relation between correction coefficient $K_P$ and $(T_P-T_{P\alpha\text{-}N})$.

In step S16, the correction coefficient $K_P$ for correcting the purge gas quantity, which is determined in such a manner as will be described hereinlater, is determined in accordance with $(T_P-T_{P\alpha\text{-}N})$. The correction coefficient $K_P$ is set to such a value as to allow the purge gas quantity to increase as $(T_P-T_{P\alpha\text{-}N})$ becomes larger, i.e., the altitude becomes higher and specifically retrieved from the map table shown in FIG. 9 and stored in a read-only memory (ROM).

Step S17 and onward are the same as the step S4 and onward in FIG. 3.

In this embodiment, as described above, the purge gas quantity is increased as the difference between the basic fuel injection quantity $T_P$ which is calculated depending upon engine speed N and flow rate Q of intake air and the basic fuel injection quantity $T_{P\alpha\text{-}N}$ which is determined depending upon engine speed N and throttle opening area α, becomes larger, i.e., the altitude becomes higher.

Then, a further embodiment will be described.

This embodiment is constructed so as to estimate the altitude based on the result of comparison between the flow rate $Q_{\alpha\text{-}N}$ of intake air (i.e., flow rate of intake air passing throttle valve) determined depending upon detected throttle opening area α and the flow rate Q of intake air detected by the air flow meter 13.

That is, in this embodiment, the altitude detecting means 5 is constituted by an opening area α detecting means for detecting a throttle opening area α, an intake air flow rate determining means for determining a flow rate $Q_{\alpha\text{-}N}$ of throttle-passed intake air depending up a detected opening area, an air flow meter 13 for detecting the flow rate Q of intake air, and a means for estimating an altitude from the result of comparison between the flow rate $Q_{\alpha\text{-}N}$ of throttle-passed intake air determined as above and the detected flow rate Q of intake air.

Figure 10:
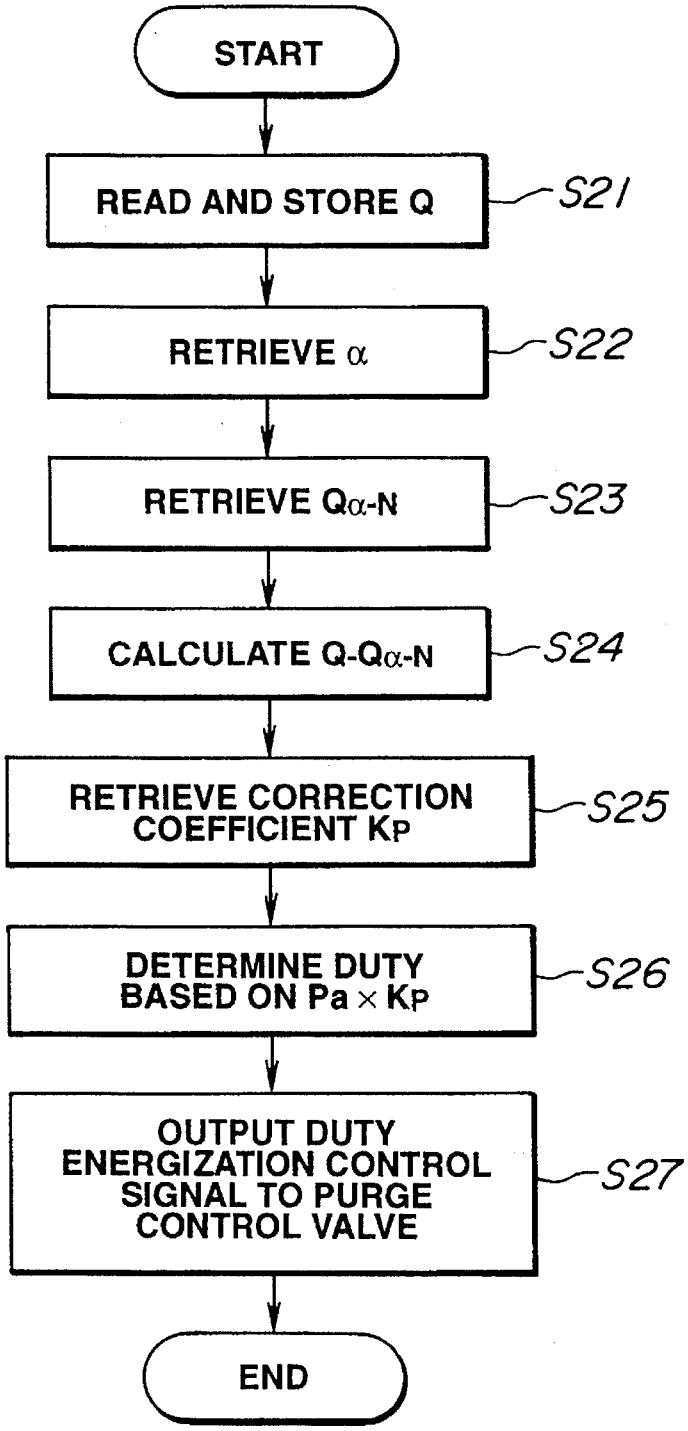
FIG. 10 is a flow chart for illustration of a control effected by a fuel vapor control system according to a further embodiment of the present invention.

The control routine of this embodiment will be described with reference to the flow chart of FIG. 10.

Figure 11:
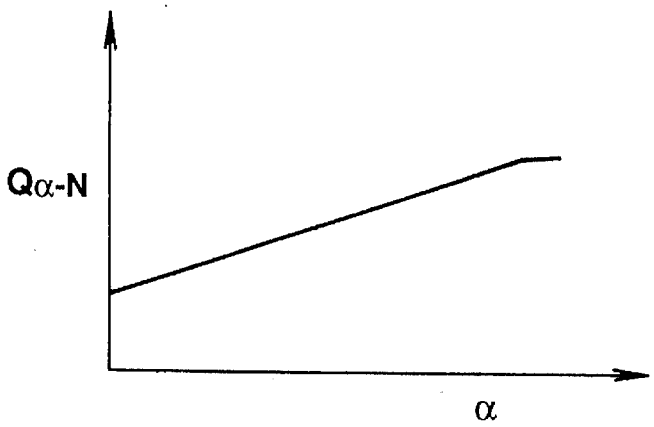
FIG. 11 is a graph for illustration of a map table, previously stored, of throttle-passed intake air quantity $Q_{\alpha\text{-}N}$ in relation to a parameter of throttle opening area $\alpha$.

In step S21, a flow rate Q of intake air detected by the air flow meter 13 is read and stored. In step S22, the throttle opening area α corresponding to the present throttle valve opening degree TVO is retrieved from the map table, stored in a read-only memory (ROM), of throttle opening area α in relation to a parameter of throttle valve opening TVO, as shown in FIG. 7. In step 23, the flow rate $Q_{\alpha\text{-}N}$ of throttle-passed intake air corresponding to the present throttle opening area α is retrieved from the map table of FIG. 11 previously stored in a read-only memory (ROM) for determining a flow rate $Q_{\alpha\text{-}N}$ of throttle-passed intake air in relation to a parameter of a throttle opening area α.

In step S24, the difference $(Q-Q_{\alpha\text{-}N})$ between the flow rate Q of intake air obtained in the step S21 and the flow rate $Q_{\alpha\text{-}N}$ of intake air obtained in the step S22, is calculated.

In this instance, the above described difference $(Q-Q_{\alpha\text{-}N})$ is mutually related to the altitude and becomes larger as the altitude increases. Accordingly, the altitude can be estimated from $(Q-Q_{\alpha\text{-}N})$.

Figure 12:
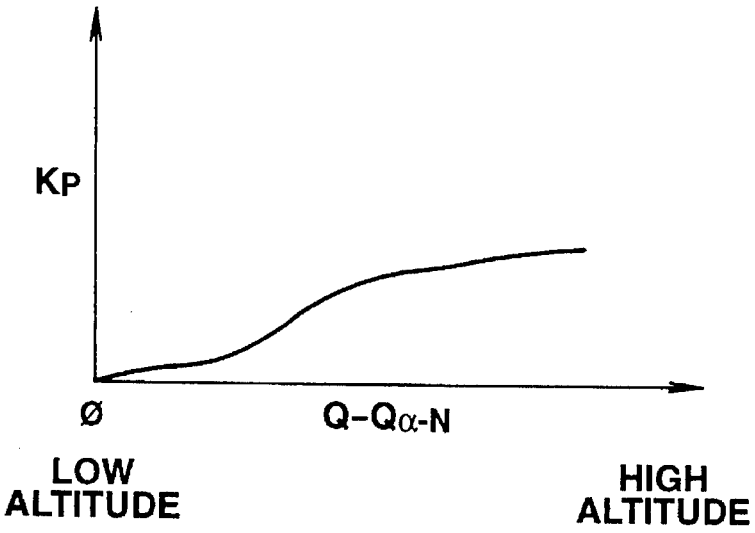
FIG. 12 is a graph for illustration of a map table, previously stored, of a relation of correction coefficient $K_P$ and $(Q-Q_{\alpha\text{-}N})$.

In step S25, the correction coefficient $K_P$ for correcting the purge gas quantity which is determined in such a manner as will be described hereinlater, is determined based on $(Q-Q_{\alpha\text{-}N})$. This correction coefficient $K_P$ is set to such a value as to allow the purge gas quantity to increase as $(Q-Q_{\alpha\text{-}N})$ becomes larger, i.e., as the altitude becomes higher, and is actually retrieved from the map table of FIG. 12 previously stored in a read-only memory (ROM).

Figure 6:
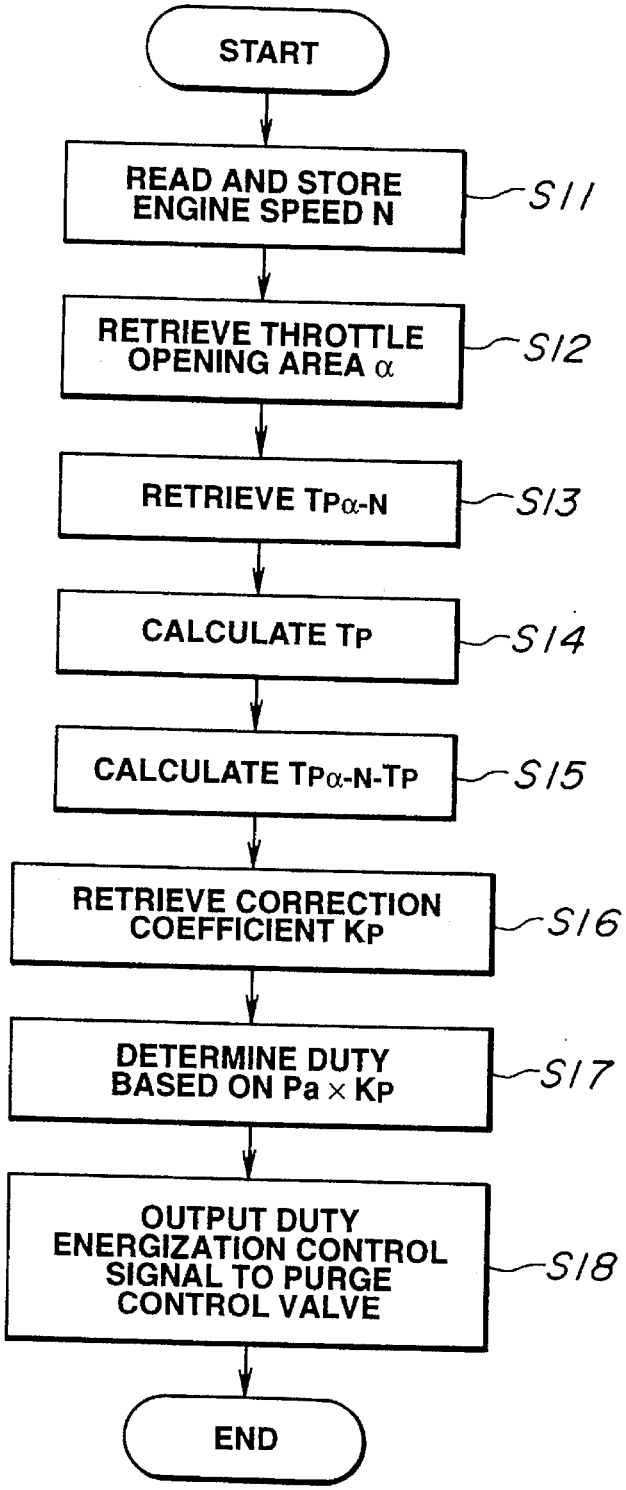
FIG. 6 is a flow chart for illustration of a control effected by a vapor fuel control system according to another embodiment of the present invention.

Step S26 and onward are the,same as the step S17 and onward in FIG. 6.

In this embodiment, as described above, the purge gas quantity increases as the difference between the flow rate Q of intake air detected by the air flow meter 13 and the flow rate $Q_{\alpha\text{-}N}$ of throttle-passed intake air determined depending upon the detected throttle opening area α, becomes larger, i.e., as the altitude becomes higher.

What is claimed is:

1. A fuel vapor control system for an internal combustion engine, comprising:

fuel vapor adsorbing means for adsorbing fuel vapor produced in a fuel supply system of the engine;

purge means for purging fuel vapor from said fuel vapor adsorbing means and supplying it together with air to an intake system of the engine;

purge gas quantity altering means for altering a quantity of purge gas purged from said fuel vapor adsorbing means and supplied to the intake system of the engine by said purge means;

engine operating condition detecting means for detecting an operating condition of the engine;

basic purge gas quantity determining means for determining a basic purge gas quantity based on the engine operating condition detected by said engine operating condition detecting means;

altitude detecting means for detecting an altitude at which the engine is located and producing a signal representative thereof;

purge gas quantity correcting and determining means for correcting said basic purge gas quantity determined by said basic purge gas quantity determining means, in response to the signal from said altitude detecting means and determining a conclusive purge gas quantity; and purge gas quantity control means for controlling said purge gas quantity altering means based on said conclusive purge gas quantity, wherein said altitude detecting means comprises engine speed detecting means for detecting an engine speed, opening area detecting means for detecting an opening area of the intake system controlled by an intake air flow rate control means, intake air flow rate detecting means for detecting a flow rate of intake air, basic fuel supply quantity determining means for determining a determined basic fuel supply quantity depending upon detected engine speed and detected opening area, basic fuel supply quantity calculating means for calculating a calculated basic fuel supply quantity depending upon the detected engine speed and the detected flow rate of intake air, and means for estimating said altitude from a result of comparison between said determined basic fuel supply quantity and said calculated basic fuel supply quantity.

2. A fuel vapor control means for an internal combustion engine, comprising:

fuel vapor adsorbing means for adsorbing fuel vapor produced in a fuel supply system of the engine;

purge means for purging fuel vapor from said fuel vapor adsorbing means and supplying it together with air to the intake system of the engine;

purge gas quantity altering means for altering a quantity of purge gas purged from said fuel vapor adsorbing means and supplied to the intake system of the engine by said purge means;

engine operating condition detecting means for detecting an operating condition of the engine;

basic purge gas quantity determining means for determining a basic purge gas quantity based on the engine operating condition detected by said engine operating condition detecting means;

altitude detecting means for detecting an altitude at which the engine is located and producing a signal representative thereof;

purge gas quantity correcting and determining means for correcting said basic purge gas quantity determined by said basic purge gas quantity determining means, in response to the signal from said altitude detecting means and determining a conclusive purge gas quantity; and purge gas quantity control means for controlling said purge gas quantity altering means based on said conclusive purge gas quantity, wherein said altitude detecting means comprises opening area detecting means for detecting an opening area of the engine intake system controlled by an intake air flow rate control means, intake air flow rate determining means for determining a determined intake air flow rate based on the detected opening area, intake air flow rate detecting means for detecting a detected intake air flow rate, and means for estimating said altitude from a result of comparison between said determined intake air flow rate and said detected intake air flow rate.

3. A purge gas control system for an internal combustion engine, comprising:

altitude detecting means for detecting an altitude at which the engine is located; and purge gas quantity control means for controlling a quantity of purge gas supplied to the engine depending upon said altitude detected by said altitude detecting means, wherein said altitude detecting means comprises means for estimating said altitude depending upon a difference ($T_P$–$TP_{\alpha\text{-}N}$) where $T_P$ is a basic fuel supply quantity calculated depending upon an engine speed and a flow rate of intake air and $TP_{\alpha\text{-}N}$ is a basic fuel supply quantity determined depending upon the engine speed and a throttle valve opening degree.

4. A purge gas control system for an internal combustion engine, comprising:

altitude detecting means for detecting an altitude at which the enqine is located; and purge gas quantity control means for controlling a quantity of purge gas supplied to the engine depending upon said altitude detected by said altitude detecting means, wherein said altitude detecting means comprises means for estimating said altitude depending upon a difference ($Q$–$Q_{\alpha\text{-}N}$) where Q is a flow rate of intake air detected by an airflow meter and $Q_{\alpha\text{-}N}$ is a flow rate of intake air determined depending upon a throttle opening area.

* * * * *